US006930657B2

(12) United States Patent
Abe

(10) Patent No.: US 6,930,657 B2
(45) Date of Patent: Aug. 16, 2005

(54) ORGANIC EL ELEMENT DRIVE CIRCUIT AND ORGANIC EL DISPLAY DEVICE

(75) Inventor: Shinichi Abe, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 318 days.

(21) Appl. No.: 10/393,915

(22) Filed: Mar. 24, 2003

(65) Prior Publication Data

US 2003/0184504 A1 Oct. 2, 2003

(30) Foreign Application Priority Data

Mar. 27, 2002 (JP) ..... 2002-087953

(51) Int. Cl.[7] ..... G09G 3/36
(52) U.S. Cl. ..... 345/76; 345/91
(58) Field of Search ..... 345/76, 77, 78, 345/80, 84, 91, 204, 208; 315/169.1, 169.3

(56) References Cited

U.S. PATENT DOCUMENTS 6,369,515 B1 * 4/2002 Okuda ..... 315/169.3
6,376,994 B1 * 4/2002 Ochi et al. ..... 315/169.1
6,429,837 B1 * 8/2002 Ishizuka et al. ..... 345/74.1
6,486,607 B1 * 11/2002 Yeuan ..... 315/169.1
6,534,925 B2 * 3/2003 Kawashima ..... 315/169.1
6,586,888 B2 7/2003 Takekawa et al. ..... 315/169.1
6,707,438 B1 * 3/2004 Ishizuka et al. ..... 345/78
6,771,235 B2 * 8/2004 Ishizuka et al. ..... 345/77
6,774,878 B2 * 8/2004 Yoshida et al. ..... 345/76
2002/0033782 A1 3/2002 Ogusu et al. ..... 345/76
2004/0041525 A1 * 3/2004 Park et al. ..... 315/169.3

* cited by examiner

*Primary Examiner*—Amare Mengistu
*Assistant Examiner*—Nitin Patel
(74) *Attorney, Agent, or Firm*—Mattingly, Stanger, Malur & Brundidge, P.C.

(57) ABSTRACT

Electric charges accumulated in organic EL elements are discharged by applying a voltage for reverse-biasing the organic EL elements from at least one of a plurality of current drive circuits, which is connected to a line scanned at least one line ahead of a line to be scanned currently, to the line associated therewith and by connecting cathode connection lines connected to the current drive circuits other than the current drive circuit to be scanned currently and the line scanned at least one line ahead of the current drive circuit to be scanned currently to a predetermined biasing line. Thus, one or several lines accumulate charges corresponding to the reverse-biasing, so that the total power consumption can be reduced.

16 Claims, 4 Drawing Sheets

ORGANIC EL ELEMENT DRIVE CIRCUIT AND ORGANIC EL DISPLAY DEVICE

BACKGROUND OF THE INVENTION

1. Field of the Invention

The present invention relates to an organic EL (Electro Luminescence) element drive circuit and an organic EL display device and, in particular, the present invention relates to an organic EL element drive circuit capable of preventing erroneous light emission of matrix-arranged organic EL elements and reducing power consumption thereof and an improvement of an organic EL display device.

2. Description of the Related Art

Since an organic EL display device can perform a high luminance display due to spontaneous light emission, the organic EL display device is suitable for use in a display device whose display screen size is small and is expected as the next generation display device to be mounted on such as a portable telephone set, a DVD player or a PDA (personal digital assistance), etc. A known problem of the organic EL display device is that variation of luminance becomes considerable when a voltage drive is applied to the organic EL display device as in a liquid crystal display device and the drive control becomes difficult due to the difference in sensitivity between R (red), G (green) and B (blue).

In view of this problem, an organic EL display device using a current driver is proposed recently. For example, in JP H10-112391A, a technique for solving the problem of luminance variation by employing the current drive is disclosed.

In a recent organic EL display panel of an organic EL display device for use in a portable telephone set, the number of terminal pins of column lines is 396 (132×3) and the number of terminal pins of row lines is 162. These numbers of the terminal pins are still increasing.

An output stage of each of current drive circuits of such organic EL display panel includes a drive circuit of a power source corresponding to each terminal pin such as, for example, a current mirror output circuit regardless of the type of driving, that is, the active matrix type or the simple matrix type. In, for example, U.S. application Ser. No. 10,102,671, which corresponds to Japanese Application JP 2002-82662 claiming domestic priorities of Japanese Application JP2001-86967 and Japanese Application JP2001-396219, a drive stage includes a parallel driven current mirror circuit (reference current distribution circuit) having output side transistors the number of which corresponds to the number of terminal pins and drives the output circuit by generating a corresponding number of mirror currents on the basis of a reference current supplied from a reference current generator circuit provided precedent to an input of the drive stage and distributing these mirror currents to the respective terminal pins. Alternatively, the mirror currents distributed to the terminal pins are amplified by k times (k is an integer equal to or larger than 2) and drive the output circuits. The k-time amplifier circuit is disclosed in Japanese Application JP2002-33719 assigned to the assignee of this application, in which a D/A converter circuit is provided for each terminal pin. In the k-time amplifier circuit, the D/A converter circuits corresponding to the respective column side terminal pins receive display data and column side drive currents for the respective terminal pins are generated simultaneously by A/D converting the column data.

It is general, in the organic EL display device, that one of the column side (anode side) lines becomes the current discharge side and the row side (cathode scan side) lines becomes the current sink side. Drive currents from the column side current drive circuits are supplied to the anode side of the organic EL elements correspondingly to the row side scan. The cathode side of the organic EL elements is grounded through CMOS push-pull circuits to sink the drive currents. Since the organic EL element is a capacitive element, a portion of the drive current is accumulated in the organic EL element as electric charge. Therefore, in the display device having a matrix-arranged organic EL elements, charges may flow from the organic EL elements arranged in the peripheral portion of the panel, which are not to be scanned, into the organic EL element, which is to be scanned. Consequently, there is a problem that the organic EL elements, which are not scanned, emit light and/or the luminance of the driven organic EL elements varies, resulting in erroneous light emission.

FIG. 6 schematically shows an organic EL display panel of a conventional organic EL display device. The conventional organic EL display panel 1 includes matrix-arranged organic EL elements 4, column side current drive circuits 2 and row side drive circuits 3. In FIG. 6, the organic EL elements 4 are shown as capacitors and a CMOS push-pull circuit of the drive circuit 3 is shown as a pair of series connected switches, for convenience.

In the organic EL display panel 1, in order to improve the luminance of the organic EL elements 4 and to prevent the luminance thereof from being varied, the organic EL elements 4 are preliminarily charged for a constant time, which is determined by the junction capacitances thereof. Therefore, switch circuits SW each provided between the column side current drive circuit 2 and the ground line are made ON for a constant time before the drive is started, to discharge electric charges of the organic EL elements 4 to thereby reset the organic EL elements. The resetting of the organic EL elements is performed by making the switch circuits SW ON for an initial constant time for which a row side line of the row side drive circuit 3, which is to be scanned, becomes low (L) level to ground column lines (anode side lines) X1, X2, X3, . . . connected to outputs of the current drive circuits 2. Thus, residual charge of the organic EL elements 4 are discharged and, thereafter, the output currents of the column side current drive circuits 2 are supplied to the organic EL elements 4. In the row side drive circuits 3, the organic EL elements 4, which are to be not scanned, are reverse-biased. Otherwise, the drive current flows in the organic EL element 4, which is to be scanned, also flows into other organic EL elements arranged around the organic EL element 4, causing the erroneous light emission. Therefore, the row lines (cathode side lines) Y1, Y2, Y3, . . . , which are to be not scanned, are fixed to High (H) level.

There is a recent tendency that the number of the drive pins is increased concomitantly with the request of higher resolution. When the number of the drive pins is increased, the drive frequency tends to become higher and the power consumption tends to increase. However, when, in order to prevent the erroneous light emission, the organic EL elements other than that to be scanned are reverse-biased on the row side, charge for the reverse-biasing is accumulated in the organic EL elements in a direction opposite to the drive direction. Therefore, when a certain row line becomes one to be scanned, a large transient current flows to drive the row line while canceling out the charge stored therein in the reverse direction. As a result, the increase of the power consumption due to current required to store the charge for the reverse-biasing and the drive current due to the transient current become not negligible when the number of the drive pins is increased.

SUMMARY OF THE INVENTION

An object of the present invention is to provide an organic EL element drive circuit capable of preventing the erroneous light emission of matrix-arranged organic EL elements and reducing the power consumption thereof and an organic EL display device using the same.

In order to achieve this object, according to the present invention, an organic EL element drive circuit for an organic EL display panel including a plurality of matrix-arranged organic EL elements comprises a plurality of current sources provided correspondingly to a plurality of anode connection lines connected to anode sides of the respective organic EL elements, a plurality of drive circuits provided correspondingly to a plurality of cathode connection lines connected to cathode sides of the respective organic EL elements, for sequentially scanning the cathode connection lines and sinking currents flowing out from the cathode connection lines to a predetermined biasing line having a predetermined constant voltage and a discharge circuit for discharging electric charges of the organic EL elements by connecting the anode connection lines to the predetermined biasing line or a predetermined constant voltage line for a constant time, wherein at least one of the drive circuits, which is connected to one of the cathode connection lines to be scanned, connects the cathode connection line to the predetermined biasing line, at least one of the remaining drive circuits, which is connected to at least one of the cathode connection lines, which was scanned one or a plurality lines ahead of the cathode connection line to be scanned, applies a voltage for reverse-biasing the organic EL element to the cathode connection line associated therewith and the remaining drive circuits connected to the remaining cathode connection lines connect the cathode connection lines associated therewith to the predetermined biasing line for the constant time.

In the present invention, at least one of the drive circuits, connected to the cathode connection line, which was scanned one or a plurality of lines ahead of the cathode connection line to be scanned currently, applies a voltage for reverse-biasing the organic EL element to the cathode connection line associated therewith and the drive circuits other than the at least one drive circuit and the drive circuit connected to the cathode connection line to be scanned currently connect the cathode connection lines associated therewith to the predetermined biasing line for the constant time to discharge the electric charges stored in the organic EL elements. Since the drive circuit connected to the cathode connection line to be scanned currently connects the associated cathode connection line on the row side to the predetermined biasing line, charges stored in the associated organic EL element is also discharged for the constant time.

Therefore, only one or several scan lines preceding to the line under scan contribute to the storage of charge for the reverse-biasing and, therefore, the increase of drive current due to transient current is restricted and the total power consumption can be reduced.

As a result, it is possible to prevent the erroneous light emission of the matrix-arranged organic EL elements and to reduce the power consumption.

An organic EL display device according to the present invention is featured by using the organic EL element drive circuit mentioned above.

DETAILED DESCRIPTION OF THE PREFERRED EMBODIMENTS

Figure 1:
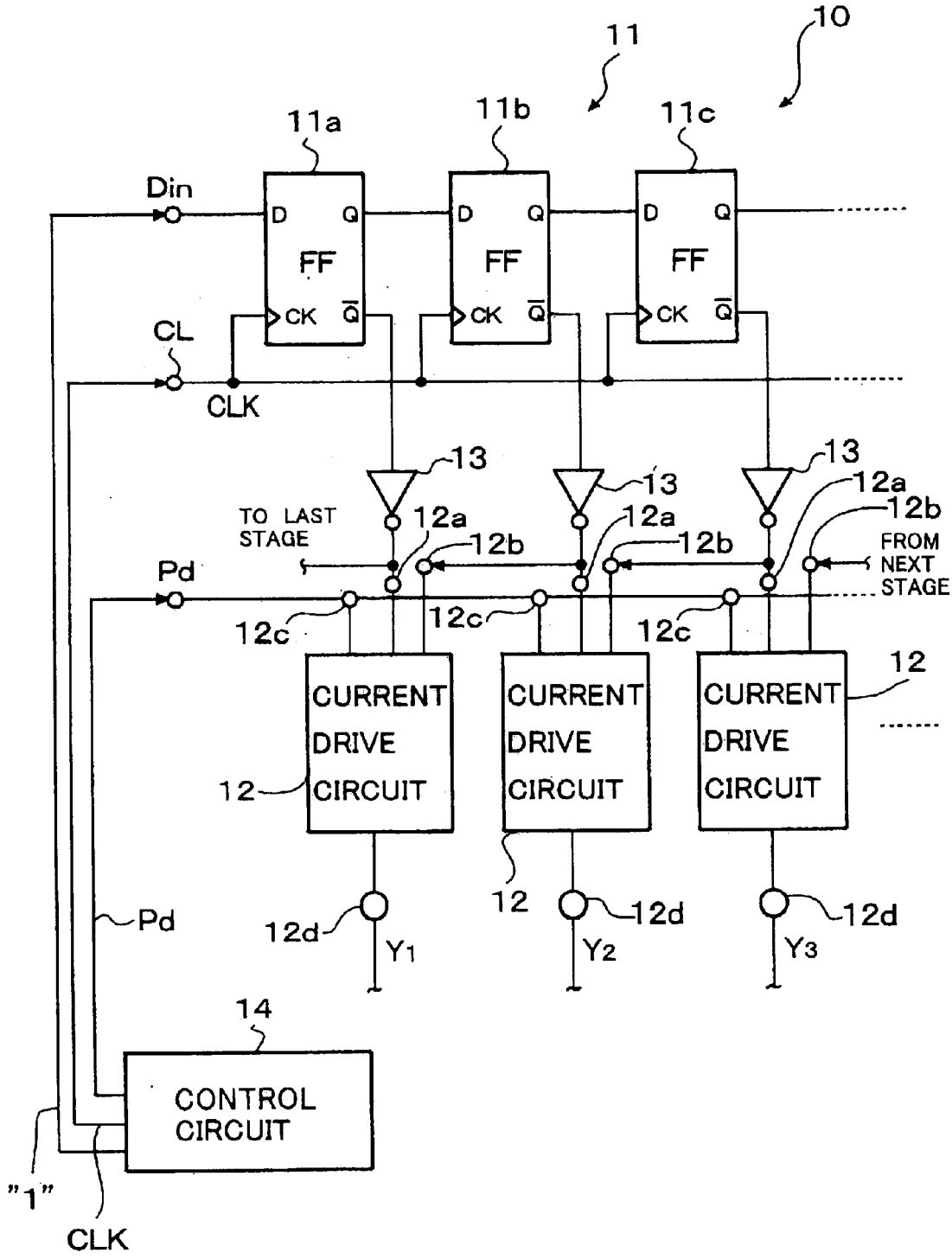
FIG. 1 is a block circuit diagram showing a scan circuit on a row side of an organic EL element drive circuit according to an embodiment of the present invention.

In FIG. 1, a row side scan circuit 10 includes a shift register 11 composed of series connected flip-flops (FFs) 11*a*, 11*b*, 11*c*. The number of the flip-flops corresponds to the number of row side scan lines. Each flip-flop has a data terminal D, which receives a Q output of a preceding flip-flop and a clock terminal CK, which receives a row clock CLK from a control circuit 14 through a terminal CL of the shift register 11.

The data terminal D of the initial stage flip-flop 11*a* is supplied with a 1-bit data "1" from the control circuit 14 through a data input terminal Din of the shift register 11. Each flip-flop has an inverted Q output terminal, which outputs an inverted Q. The inverted Q output of each of the flip-flops is supplied to a current drive circuit 12 associate with the flip-flop through an inverter 13. An inverted Q output of each of the inverters 13 except the initial stage flip-flop 11*a* is also inputted to the current drive circuit 12 associated with a preceding flip-flop in a stage preceding to the flip-flop.

Incidentally, in the drawings, same or similar constitutional components are depicted by the same reference numerals, respectively.

The inverted Q outputs from the flip-flops except the initial stage flip-flop are inverted by the inverters 13 and inputted to the current drive circuits 12 associated therewith, respectively. The output of each of the inverters 13 is also supplied to the current drive circuit 12 in a stage preceding to the stage to which the inverter 13 belongs.

The output of the inverter 13 associated with the initial stage flip-flop is supplied to the current drive circuit 12 associated therewith and the current drive circuit 12 associated with the last stage flip-flop. In this case, it may be possible to provide a dummy flip-flop corresponding to the initial stage flip-flop in a downstream side of the last stage flip-flop and to supply an output of the dummy flip-flop to the current drive circuit 12 associated with the last stage flip-flop through the inverter thereof. In the latter case, a wiring for inputting the output of the inverter 13 associated with the initial stage flip-flop to the current drive circuit 12 associated with the last stage flip-flop becomes unnecessary, so that an layout of the wiring connection line becomes simplified.

The control circuit 14 generates the row clock CLK and the row data "1" to be supplied to the shift register 11 and also generates a discharge pulse Pd to be supplied to the respective current drive circuits 12.

The current drive circuits 12 associated with the respective flip-flops receive the inverted Q outputs of the flip-flops through the inverters 13 also associated with the respective flip-flops. As a result, the output signals of the inverters 13 inputted to the current drive circuits 12 correspond to the Q outputs of the flip-flops.

In the shift register 11, the 1-bit data "1" from the control circuit 14 is shifted sequentially from the initial stage flip-flop 11*a* toward the last stage flip-flop according to the row clock CLK starting at a scan start time on the row side. Therefore, the current drive circuit 12, which receives the inverted Q output of the flip-flop having the bit data "1" set, generates a "L" level output signal on a row line (cathode side line) to be scanned. Thus, the row lines Y1, Y2, Y3, . . . are driven sequentially. Since, in this case, the remaining flip-flops are set to "0" state, the current drive circuits 12 associated therewith are not scanned.

Figure 2:
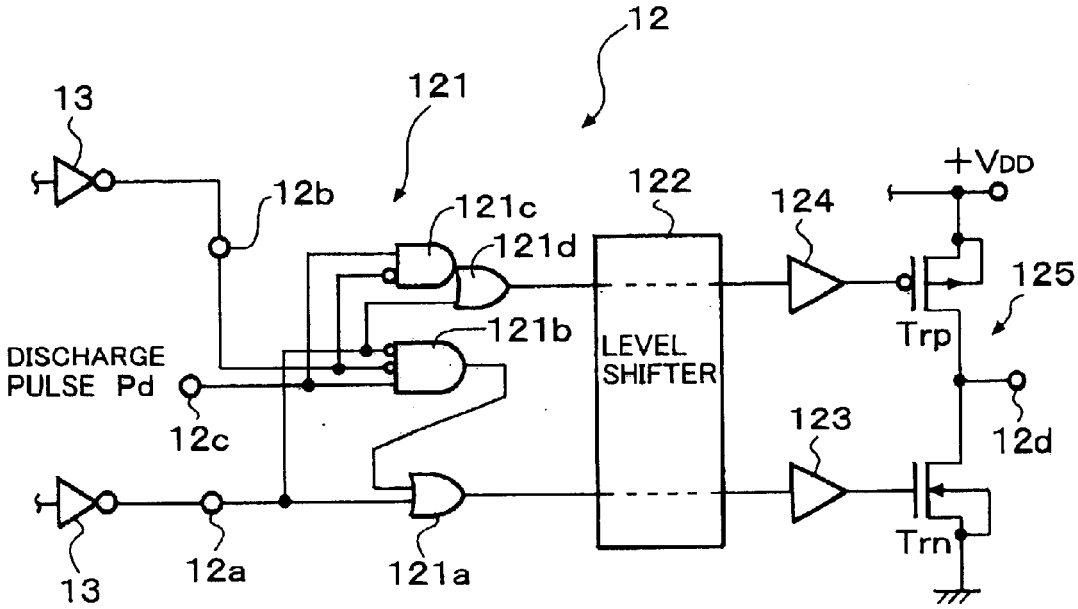
FIG. 2 is a block circuit diagram of a current drive circuit of the organic EL element drive circuit shown in FIG. 1.

As shown in FIG. 2 showing one of the identical current drive circuits, the current drive circuit 12 is constructed with a logic circuit 121, a level shifter circuit 122, buffers 123 and 124 and a CMOS output circuit 125 composed of CMOS transistors Trp and Trn. Output terminals 12*d* of the CMOS output circuits 125 of the current drive circuits 12 are connected to the row side lines Y1, Y2, Y3, . . . , respectively, as shown in FIG. 1. The current drive circuits 12, except the current drive circuit 12 associated with the scan line to be scanned currently and the current drive circuit 12 scanned immediately preceding to the former current drive circuit, receive the outputs (first drive signals) of the inverters 13 associated therewith, the discharge pulse Pd and outputs (second drive signals) of the inverters 13 in the succeeding stages to make the row lines Y1, Y2, Y3, . . . in "L" level for a constant time period during the discharge operation (see the width of the discharge pulse Pd in FIG. 3).

Describing the current drive circuit 12 in a certain stage with reference to FIG. 1 and FIG. 2, the current drive circuit 12 receives the output signal of the inverter 13 associated therewith, the output signal of the inverter 13 of a next stage and the discharge pulse Pd at its input terminals 12*a*, 12*b* and 12*c*, respectively.

The logic circuit 121 is constructed with 2-input OR gates 121*a* and 121*d*, a 3-input AND gate 121*b* and a 2-input AND gate 121*c*. One input of the 2-input OR gate 121*a* is connected to an output terminal of the associated inverter 13 and the other input thereof is connected to an output of the 3-input AND gate 121*b*. An output signal of the 2-input OR gate 121*a* is supplied to a gate of the transistor Trn of the CMOS output circuit 125 through the level shifter circuit 122 and the buffer 123.

The 3-input AND gate 121*b* has an input terminal supplied with the discharge pulse Pd through the input terminal 12*c* of the current drive circuit 12, one negative logic input terminal supplied with an output signal of the next stage inverter 13 through the input terminal 12*b* of the current drive circuit 12 and the other negative logic input terminal supplied with the output signal of the inverter 13 through the input terminal 12*a*. The output of the 3-input AND gate 121*b* is supplied to the other input of the 2-input OR gate 121*a* as mentioned. The transistor Trn of the CMOS transistor 125 is turned ON when the output of the 2-input OR gate is "H" and turned OFF when the output is "L".

Therefore, when the discharge pulse Pd is "H", the transistor Trn becomes ON. However, the 3-input AND gate 121*b* blocks the discharge pulse Pd according to the signal levels at the negative logic input terminals when the associated current drive circuit 12 is an object to be scanned on row side or when the current drive circuit 12 associated with the next stage is an object to be scanned on the row side. Therefore, under either of the above conditions, the ON/OFF control of the transistors Trn and Trp is performed regardless of the discharge pulse Pd.

Similarly, the 2-input AND gate 121*c* has an input terminal supplied with the discharge pulse Pd through the input terminal 12*c* and a negative logic input terminal supplied with the output signal of the inverter 13 of the next stage through the input terminal 12*b*. An output of the 2-input AND gate 121*c* is supplied to one of the input terminals of the 2-input OR gate 121*d* having the other input terminal supplied with the output signal of the inverter associated with the certain flip-flop and, when the output of the 2-input AND gate 121*c* is "L", the 2-input OR gate 121*d* drives the transistor Trp of the CMOS output circuit 125 to turn the transistor Trp ON. When the output of the 2-input OR gate 121*d* is "H", the transistor Trp of the CMOS output circuit 125 becomes OFF. Thus, when the output signal of the inverter 13 of the next stage is "H", the discharge pulse Pd is blocked. In other words, when the current drive circuit 12 associated with the next stage is the object to be scanned on the row side, the discharge pulse Pd is blocked. That is, the ON/OFF operation of the transistors Trn and Trp is independent from the discharge pulse Pd.

When the current drive circuit 12 is the object to be scanned on the row side, the drive signal (the output signal of the inverter 13) in "H" level inputted to the input terminal 12*a* is supplied to the gate of the transistor Trp through the OR gate 121*d* to turn the transistor Trp OFF regardless of the discharge pulse Pd, so that the output terminal 12*d* is grounded.

Therefore, under the condition that the current drive circuit 12 is the object to be scanned on the row side or that the current drive circuit 12 of the next stage is the object to be scanned on the row side, the logic circuit 121 sends the output signal "H" or "L" to the CMOS output circuit 125 through the OR gates 121*a* and 121*d* according to the output signal "H" or "L" of the inverter 13 of the associated stage to perform the ON/OFF control of the transistor Trn or Trp independently from the state of the discharge pulse Pd.

As a result, the discharge pulse Pd is blocked by the 3-input AND gate 121*b* and the 2-input AND gate 121*c*, so that the CMOS output circuit 125 of the current drive circuit 12 associated with the row line, which is the object to be scanned, generates the signal "L" at its output terminal 12*d* and the CMOS output circuit 125 of the preceding stage, which was the object to be scanned one line ahead of the row line and is currently the object to be not scanned, generates the signal "H" at its output terminal 12*d*, resulting in a scan control similar to the conventional control.

In cases other than the above mentioned case, the output of the inverter 13 associated with the flip-flop of a certain stage is "L" and the output of the inverter 13 associated with the flip-flop of a stage succeeding to the certain stage is also "L". Therefore, the 3-input AND gate 121*b* and the 2-input AND gate 121*c* are opened and the discharge pulse Pd in "H" level is inputted to the 2-input OR gates 121*a* and 121*d* from which the discharge pulses Pd are supplied to the gates of the transistors Trn and Trp through the level shifter circuit 122 and the respective buffers 123 and 124.

As a result, the transistors Trn and Trp of the CMOS output circuit 125 become ON and OFF, respectively, for the time in which the discharge pulse Pd is in "H" level. When the transistor Trn becomes ON for the time corresponding to the width of the discharge pulse Pd in "H" level, the row line, to which current drive circuits 12 other than the current drive circuit 12 associated with the flip-flop of the stage preceding to the stage to be scanned on the row side are connected, becomes "L" level.

Therefore, although the transistors Trn and Trp of the current drive circuit 12 are turned ON and OFF, respectively, to ground the output terminal 12*d* when the current drive circuit 12 receives the discharge pulse Pd in "H" level, the logic circuit 121 of the current drive circuit 12 generates logic outputs for controlling the transistors Trn and Trp thereof such that the output terminal 12*d* of the current drive circuit 12 associated with the row line to be scanned currently is grounded regardless of the discharge pulse Pd by turning the transistors Trn and Trp are turned OFF and ON, respectively, to connect the output terminal 12*d* of the current drive circuit 12 preceding to the current drive circuit 12 associated with the row line to be scanned to the power source line +VDD.

Figure 3:
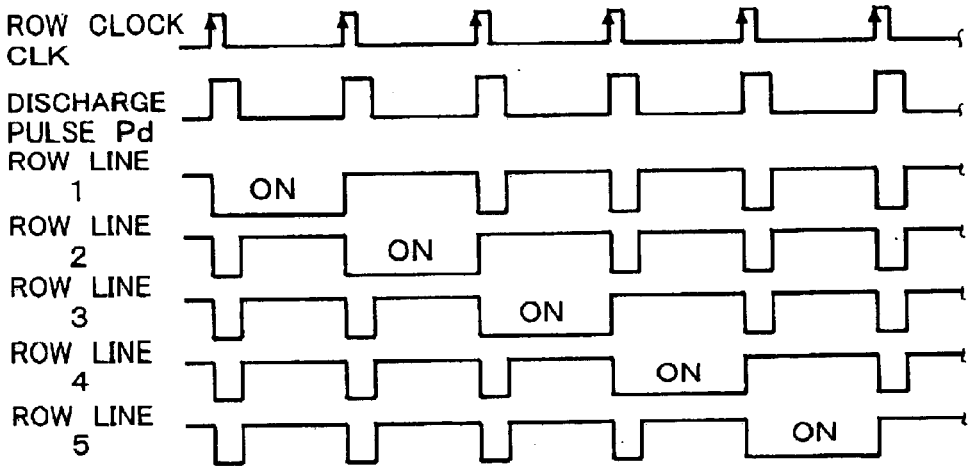
FIG. 3 is a timing chart showing a display drive operation of the current drive circuit shown in FIG. 2.

That is, as shown in FIG. 3, the output terminals 12*d* of the current drive circuits 12 other than those associated with the flip-flop of the stage corresponding to the row line to be scanned and associated with the flip-flop of the stage preceding to the former stage become "L" level for the time period in which the discharge pulse Pd is in "H" level, so that the corresponding organic EL elements are not reverse-biased. When the discharge period is terminated and the discharge pulse Pd becomes "L" level, the outputs of these current drive circuits 12 are held in "H" level to reverse-bias the organic EL elements.

Since the input terminal 12*a* of the current drive circuit 12 associated with the row line to be scanned is supplied with the signal in "H" level, the output of the 2-input AND gate 121*c* becomes "H" with which the transistor Trp is turned OFF. Since, in this case, the transistor Trp is in ON state, the output terminal 12*d* of the current drive circuit 12 associated with the row line to be scanned is maintained in "L" level regardless of the level of the discharge pulse Pd, so that the usual row side scan is performed.

As a result, the row side scan is performed sequentially as shown in FIG. 3. It is assumed in FIG. 3 that the row side line, which is to be scanned currently, is the row line 2. When the row line 2 is in "L" level, the row line 1 preceding to the row line 2 is in "H" level. Other row lines are maintained in "L" level only when the discharge pulse Pd is in "H" level.

Under such control, row lines other than a row line preceding to the row line, which is to be scanned, are grounded in the discharge period in which the pulse Pd is "H". That is, the other row lines are not reverse-biased in the discharge period in which the discharge pulse Pd is in "H". Therefore, the large transient current does not flow through the other row lines when the organic EL elements 4 are current-driven by the column side current drive circuits 12.

Further, since the row line preceding to the current row line was driven precedently, there is residual charges in the associated organic EL elements 4. However, since this preceding row line is set to "H" and reverse-biased, the erroneous light emission is prevented. As to a row line succeeding to the row line to be scanned, there is substantially no problem of residual charge since a discharge is performed repeatedly.

Thus, only the row line preceding to the row line to be scanned has charge corresponding to the reverse-biasing and the increase of drive current due to the transient current is restricted, so that the total power of display drive can be restricted.

Figure 4:
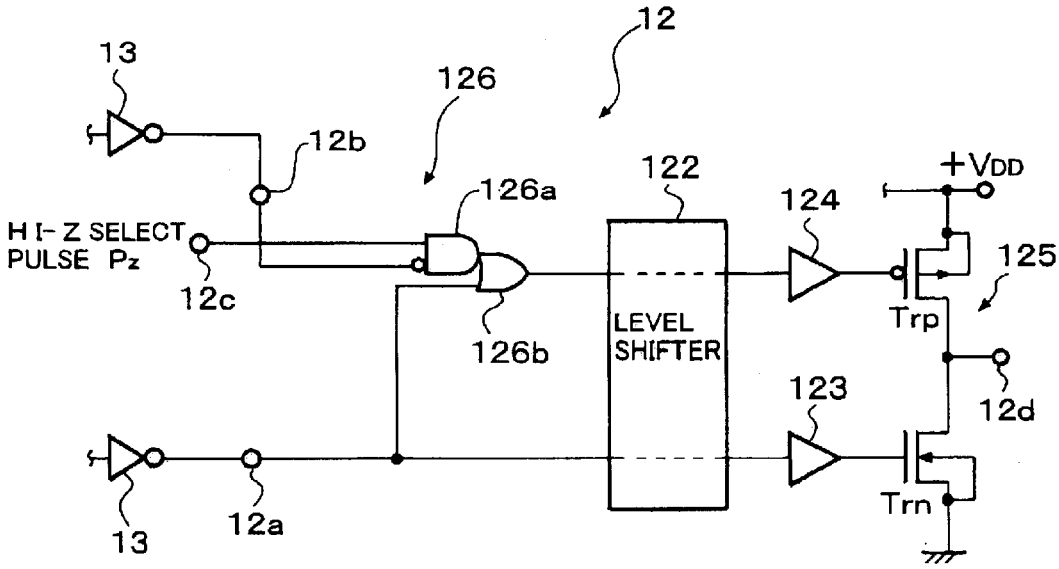
FIG. 4 is a block circuit diagram of another current drive circuit.

FIG. 4 is a block circuit diagram of the current drive circuit 12 according to another embodiment of the present invention. According to this embodiment, the impedance of the CMOS output circuits connected to lines other than that under scan becomes high (Hi-Z) for only the discharge period.

The current drive circuit 12 shown in FIG. 4 differs from the current drive circuit 12 shown in FIG. 2 in that a logic circuit 126 is used in lieu of the logic circuit 121 in FIG. 2. The logic circuit 126 includes a 2-input AND gate 126*a* and a 2-input OR gate 126*b* and generates an output, which is supplied to the gate of the transistor Trp. The signal received at the input terminal 12*a* of the logic circuit 126 is directly supplied to the gate of the transistor Trn. Therefore, the transistors Trn and Trp of the CMOS output circuit 125 of the current drive circuit 12 associated with a row line to be scanned becomes ON and OFF, respectively.

During the discharge period, the logic circuit 126 receives a Hi-Z select pulse Pz in "H" level at the input terminal 12*c*. In this embodiment, the select pulse Pz is generated by the control circuit 14 in synchronism with the discharge pulse Pd (see FIG. 5)

Figure 5:
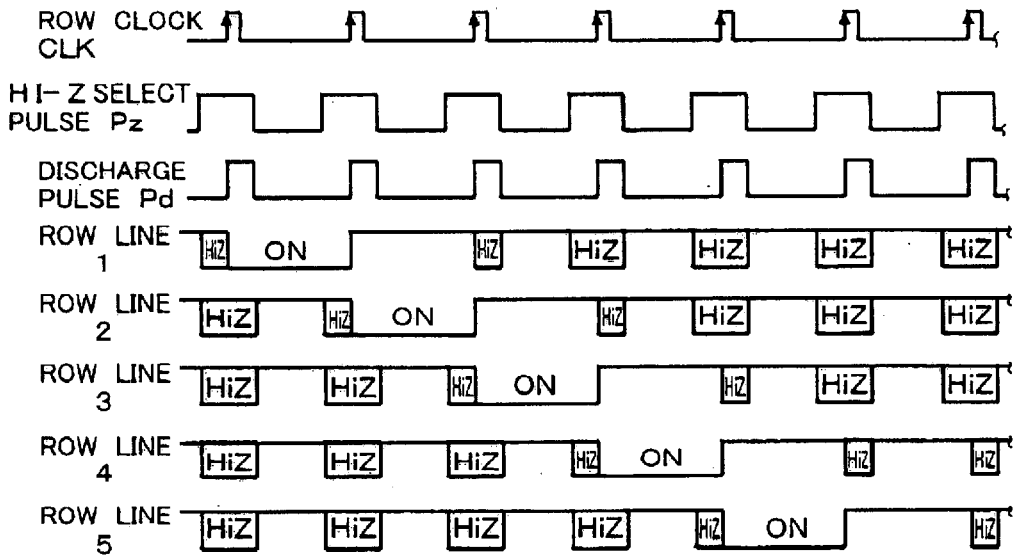
FIG. 5 is a timing chart showing a display drive operation of the current drive circuit shown in FIG. 4.
Figure 6:
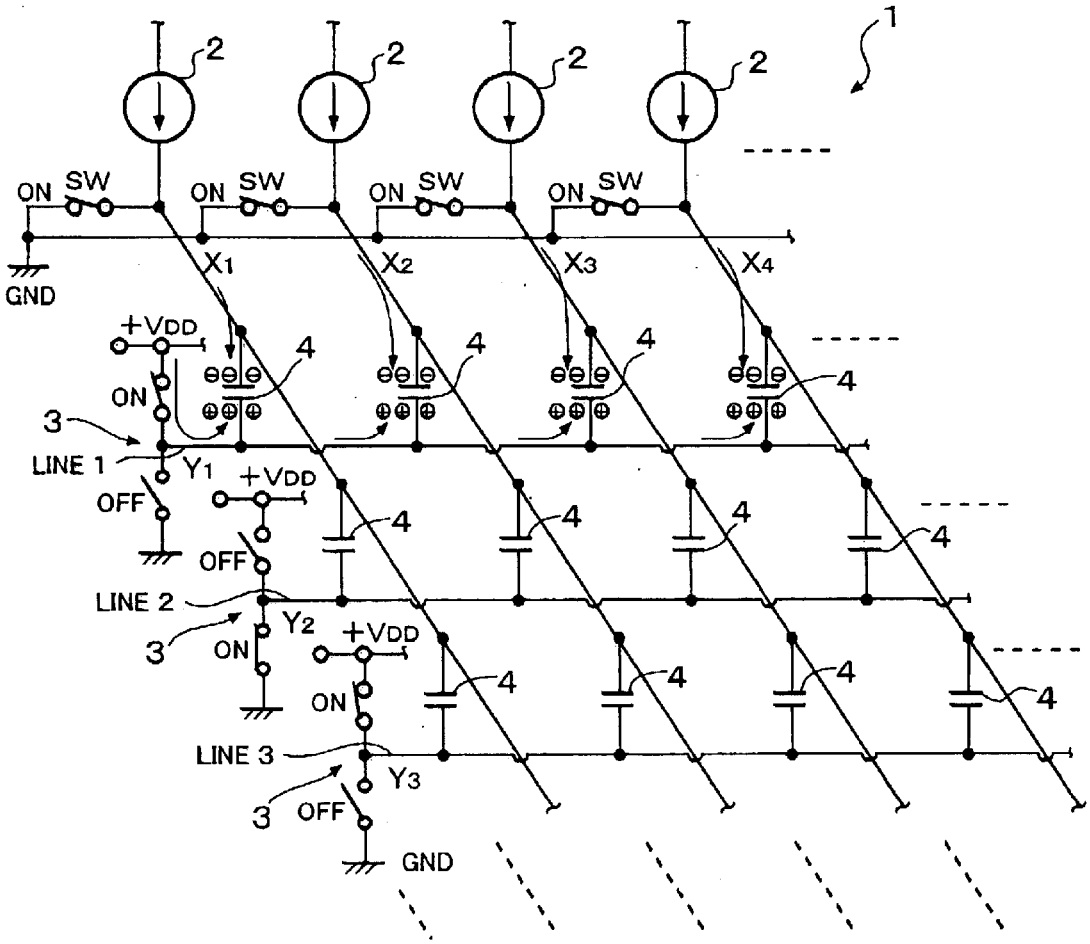
FIG. 6 shows a conventional organic EL display panel.

As shown in FIG. 5, the leading edge of the select pulse Pz is slightly before the leading edge of the discharge pulse Pd and the trailing edge thereof is coincident with the leading edge of the discharge pulse Pd.

The reverse-biasing of a row line preceding to a row line to be scanned, for preventing the erroneous light emission, is the same as that shown in FIG. 1. The select pulse Pz in "H" level supplied to the current discharge circuit 12 associated with the row line to be scanned is ignored by supplying the signal at the input terminal 12*a* to one input of the 2-input OR gate 126*b* thereof.

An output terminal of the 2-input AND gate 126*a* of the logic circuit 126 is connected to one input of the 2-input OR gate 126*b*. The other input terminal, that is, a negative logic input terminal, of the 2-input AND gate 126*a* is supplied with an output signal of the inverter 13 associated with a flip-flop in a next stage through the input terminal 12*b*. As a result, the 2-input AND gate 126*a* is opened so long as the output of the inverter 13 associated with the flip-flop of the next stage is not in "H" level, in other words, the current drive circuit 12 of the next stage is not the object to be scanned, and a "H" signal is outputted to the transistor Trp for the time period corresponding to the width of the select pulse Pz to turn the transistor Trp OFF.

Therefore, the transistors Trp of the CMOS output circuits 125 of the current drive circuits 12 other than that associated with the flip-flop of the current drive circuit 12 preceding to the current drive circuit associated with the row line to be scanned are turned OFF. Since, in the current drive circuits 12 other than the current drive circuit associated with the row line to be scanned, the row line drive signals (the output signals of the inverters 13 at the input terminals 12*a*) are in "L" level, the transistors Trn of the CMOS output circuits 125 become also OFF. Therefore, the output terminals 12*d* of these current drive circuits become Hi-Z. As a result, except the row side scan line to be scanned and the row side scan line preceding thereto, the row side scan lines to which the outputs of the CMOS output circuits 125 are connected become Hi-Z.

On the other hand, since the "H" signal is supplied to the gate of the transistor Trp of the CMOS output circuit 125 of the current drive circuit 12 associated with the row line to be scanned through the input terminal 12*a* and the 2-ibput OR gate 126*b*, the same transistor Trp is turned OFF. The transistor Trn of the same CMOS output circuit 125 is turned ON by the "H" signal supplied directly from the inverter 13 through the input terminal 12*a*. Therefore, the row side scan line connected to the output terminal 12*d* thereof is grounded and the row side scan is performed.

Since the input terminal 12*d* of the current drive circuit 12 associated with the flip-flop of the stage preceding to that associated with the row line to be scanned is "H", the Hi-Z select pulse Pz in "H" level is blocked and the signal "L" is supplied to the gate of the transistor Trp through the input terminal 12*a* and the 2-input OR gate 126*b*. Therefore, the same transistor Trp is turned ON. As a result, the output terminal 12*d* of the same current drive circuit 12 becomes "H", so that the organic EL elements 4 connected to the row line to which this "H" signal is supplied are reverse-biased.

As a result, the row side scan is performed sequentially as shown in FIG. 5. In FIG. 5, it is assumed that the row side line, which is currently scanned, is the line 2 as in the case shown in FIG. 3 and, when the line 2 is in "L" level, the line 1 preceding to the line 2 is in "H" level. Other lines become high impedance (Hi-Z) state for only the time period in which the Hi-Z select pulse Pz exists.

Although, in the embodiments of the present invention, the organic EL element drive circuit operates when the drive signal from a certain stage inverter 13 is received by the logic circuit 121 or 126 in a stage immediately preceding to the certain stage, it is of course possible to generate a drive signal corresponding to the drive signal of the inverter 13 by the logic circuit of the certain stage and send it to the logic circuit of the preceding stage. Therefore, it is not necessary to use the drive signal outputted from the inverter 13 of the following stage to drive the logic circuit 121 or 126 of the preceding stage.

In the embodiments of the present invention, the row line, which is one line ahead of the scanned row line, is set to "H" (=+VDD) by the inverted Q output from the flip-flop in the succeeding stage of the shift register 11 through the associated inverter 13. However, it is possible to make a row line, which is two lines ahead of the scanned row line, "H" by the inverted Q outputs from the flip-flop of the next stage of the shift register 11 and the flip-flop of a stage next to the next stage. Therefore, it is possible to set the row line, which is at least two line ahead of the scanned line, "H".

Since there are at least 162 row side scan lines, the increase of power consumption can be negligible even when a row line, which is a plurality of lines ahead of a scanned certain row line, is set to "H". However, when the number of lines ahead of the scanned row line, which is set "H", is increased, the size of current drive circuits is increased correspondingly. Therefore, the number of lines ahead of the scanned line should be several at most in view of the circuit size.

Further, in the embodiments, the anode side lines (column lines) is grounded according to the discharge pulse to reset them by discharging charges of the organic EL elements. However, it is possible to use the constant voltage resetting by discharging charges of the organic EL elements to a constant voltage bias line in lieu of grounding the anode side lines.

Further, although the organic EL element drive circuit according to the present invention is constructed with bipolar transistors mainly, MOS FETs may be used in lieu of the bipolar transistors. The NPN type transistors (or N channel type transistors) used in the embodiments can be replaced by PNP type (or P channel transistors) and the PNP type transistors (or P channel transistors) can be replaced by NPN type transistors (or N channel transistors). In the latter case, the power source voltage becomes negative and transistors provided upstream are provided downstream.

What is claimed is:

1. An organic EL element drive circuit for an organic EL display panel including a plurality of matrix-arranged organic EL elements, comprising:

a plurality of current sources provided correspondingly to a plurality of anode connection lines connected to anode sides of said organic EL elements, respectively;

a plurality of drive circuits provided correspondingly to a plurality of cathode connection lines connected to cathode sides of said organic EL elements, for sequentially scanning said cathode connection lines and sinking currents flowing out from said cathode connection lines to a predetermined biasing line, respectively; and a discharge circuit for discharging electric charges of said organic EL elements by connecting said anode connection lines to said predetermined biasing line or a predetermined constant voltage line for a constant time, one of the plurality of said cathode connection lines, which is to be scanned and connected to at least one of said drive circuits, being connected to said predetermined biasing line by said at least one drive circuit, at least one of the remaining drive circuits, which is connected to at least one of said cathode connection lines scanned one or a plurality of lines ahead of said cathode connection line to be scanned, applying a voltage for reverse-biasing said organic EL elements to said cathode connection lines associated therewith, the plurality of said drive circuits connected to the remaining cathode connection lines connecting said cathode connection lines associated therewith to said predetermined biasing line for the constant time.

2. An organic EL element drive circuit as claimed in claim 1, wherein each of said drive circuits includes a logic circuit and a push-pull type CMOS circuit, said predetermined biasing line having a predetermined constant voltage, said output terminal of said CMOS circuit is connected to different one of said cathode connection lines, each said CMOS circuit generates the reverse-biasing voltage on a basis of an output of said logic circuit to set a voltage of said cathode connection line to the reverse-biasing voltage, said CMOS circuit connects said cathode connection line associated therewith to said predetermined biasing line by connecting said output terminal thereof to said predetermined biasing line.

3. An organic EL element drive circuit as claimed in claim 2, wherein said push-pull type CMOS circuit having an input terminal connected to an output terminal of said logic circuit, the reverse-biasing voltage is set in only one of said cathode connection lines, said predetermined biasing line is said grounding line, said logic circuit generates a logic signal for connecting said output terminal of said CMOS circuit to said grounding line by a first drive signal for scanning a certain one of said cathode connection lines, which is to be scanned currently, received by said logic circuit and a second drive signal for scanning a next one of said cathode connection lines, which is to be scanned next, or a signal derived from the second drive signal received by said logic circuit and generates a logic signal for generating a voltage for reverse-biasing said organic EL element at said output terminal of said CMOS circuit according to one of said second drive signal and the signal derived from the second drive signal.

4. An organic EL element drive circuit as claimed in claim 3, wherein said logic circuit receives the discharge pulse for discharging electric charges of said organic EL element to generate a logic signal for connecting said cathode connection line to said grounding line through said CMOS circuit correspondingly to the discharge pulse when the first drive signal or the second drive signal is absent.

5. An organic EL element drive circuit as claimed in claim 4, further comprising a shift register the number of stages of which corresponds to the number of said drive circuits, wherein said shift register generates the drive signals for scanning in said stages sequentially by shifting a predetermined number of bits and said discharge circuit discharges the electric charges of said organic EL element to said grounding line or said predetermined constant voltage line upon the discharge pulse.

6. An organic EL element drive circuit as claimed in claim 1, wherein said drive circuit includes a logic circuit and a push-pull CMOS circuit having an output terminal to said cathode connection line, said CMOS circuit generates the reverse-biasing voltage on a basis of an output of said logic circuit to set a voltage of said cathode connection line to the reverse-biasing voltage, said CMOS circuit connects said cathode connection line associated therewith to said predetermined biasing line by connecting said output terminal thereof to said predetermined biasing line and said CMOS circuit makes the remaining cathode connection lines high impedance by setting said output terminal thereof high impedance upon the output of said logic circuit.

7. An organic EL element drive circuit as claimed in claim 6, wherein the reverse-biasing voltage is set in only one of said cathode connection lines, said predetermined biasing line is said grounding line, said logic circuit generates a logic signal for connecting said output terminal of said CMOS circuit to said grounding line by a first drive signal for scanning a certain one of said cathode connection lines, which is to be scanned currently, received by said logic circuit and a second drive signal for scanning a next one of said cathode connection lines, which is to be scanned next, or a signal derived from the second drive signal received by said logic circuit and generates a logic signal for connecting said output terminal of said CMOS circuit to said grounding line according to the first drive signal and a logic signal for generating a voltage for reverse-biasing said organic EL element at said output terminal of said CMOS circuit according to one of said second drive signal and the signal derived from the second drive signal.

8. An organic EL element drive circuit as claimed in claim 7, wherein said logic circuit receives a pulse for setting said output terminal high impedance for a predetermined time period and generates a logic signal for setting said output terminal of said CMOS circuit high impedance when the first drive signal or the second drive signal is absent.

9. An organic EL display device, comprising:

a plurality of matrix-arranged organic EL elements;

a plurality of current sources provided correspondingly to a plurality of anode connection lines connected to anode sides of said organic EL elements, respectively;

a plurality of drive circuits provided correspondingly to a plurality of cathode connection lines connected to cathode sides of said organic EL elements, for sequentially scanning said cathode connection lines and sinking currents flowing out from said cathode connection lines to a predetermined biasing line, respectively; and a discharge circuit for discharging electric charges of said organic EL elements by connecting said anode connection lines to said predetermined biasing line or a predetermined constant voltage line for a constant time, one of the plurality of said cathode connection lines, which is to be scanned and connected to one of said drive circuits, being connected to said predetermined biasing line by said one drive circuit, at least one of the remaining drive circuits, which is connected to at least one of said cathode connection lines scanned one or a plurality of lines ahead of said cathode connection line to be scanned, applying a voltage for reverse-biasing said organic EL elements to said cathode connection lines associated therewith, a plurality of said drive circuits connected to the remaining cathode connection lines connecting said cathode connection lines associated therewith to said predetermined biasing line for the constant time.

10. An organic EL display device as claimed in claim 9, wherein each of said drive circuits includes a logic circuit and a push-pull type CMOS circuit, said predetermined biasing line having a predetermined constant voltage, said output terminal of said CMOS circuit is connected to different one of said cathode connection lines, each said CMOS circuit generates the reverse-biasing voltage on a basis of an output of said logic circuit to set a voltage of said cathode connection line to the reverse-biasing voltage, said CMOS circuit connects said cathode connection line associated therewith to said predetermined biasing line by connecting said output terminal thereof to said predetermined biasing line.

11. An organic EL display device as claimed in claim 10, wherein said push-pull type CMOS circuit having an input terminal connected to an output terminal of said logic circuit, the reverse-biasing voltage is set in only one of said cathode connection lines, said predetermined biasing line is said grounding line, said logic circuit generates a logic signal for connecting said output terminal of said CMOS circuit to said grounding line by a first drive signal for scanning a certain one of said cathode connection lines, which is to be scanned currently, received by said logic circuit and a second drive signal for scanning a next one of said cathode connection lines, which is to be scanned next, or a signal derived from the second drive signal received by said logic circuit and generates a logic signal for generating a voltage for reverse-biasing said organic EL element at said output terminal of said CMOS circuit according to one of said second drive signal and the signal derived from the second drive signal.

12. An organic EL display device as claimed in claim 9, wherein said logic circuit receives the discharge pulse for discharging electric charges of said organic EL element to generate a logic signal for connecting said cathode connection line to said grounding line through said CMOS circuit correspondingly to the discharge pulse when the first drive signal or the second drive signal is absent.

13. An organic EL display device as claimed in claim 12, further comprising a shift register the number of stages of which corresponds to the number of said drive circuits, wherein said shift register generates the drive signals for scanning in said stages sequentially by shifting a predetermined number of bits and said discharge circuit discharges the electric charges of said organic EL element to said grounding line or said predetermined constant voltage line upon the discharge pulse.

14. An organic EL display device as claimed in claim 9, wherein said drive circuit includes a logic circuit and a push-pull CMOS circuit, said CMOS circuit generates the reverse-biasing voltage on a basis of an output of said logic circuit to set a voltage of said cathode connection line to the reverse-biasing voltage, said CMOS circuit connects said cathode connection line associated therewith to said predetermined biasing line by connecting said output terminal thereof to said predetermined biasing line and said CMOS circuit makes the remaining cathode connection lines high impedance by setting said output terminal thereof high impedance upon the output of said logic circuit.

15. An organic EL display device as claimed in claim 14, wherein said push-pull CMOS circuit having an output terminal to said cathode connection line, the reverse-biasing voltage is set in only one of said cathode connection lines, said predetermined biasing line is said grounding line, said logic circuit generates a logic signal for connecting said output terminal of said CMOS circuit to said grounding line by a first drive signal for scanning a certain one of said cathode connection lines, which is to be scanned currently, received by said logic circuit and a second drive signal for scanning a next one of said cathode connection lines, which is to be scanned next, or a signal derived from the second drive signal received by said logic circuit and generates a logic signal for connecting said output terminal of said CMOS circuit to said grounding line according to the first drive signal and a logic signal for generating a voltage for reverse-biasing said organic EL element at said output terminal of said CMOS circuit according to one of said second drive signal and the signal derived from the second drive signal.

16. An organic EL display device as claimed in claim 15, wherein said logic circuit receives a pulse for setting said output terminal high impedance for a predetermined time period and generates a logic signal for setting said output terminal of said CMOS circuit high impedance when the first drive signal or the second drive signal is absent.

* * * * *